US007367623B2

(12) United States Patent
Tholkes et al.

(10) Patent No.: US 7,367,623 B2
(45) Date of Patent: May 6, 2008

(54) ERGONOMIC CHAIR

(75) Inventors: Alan L. Tholkes, Burnsville, MN (US); DuWayne Dandurand, Belle Plaine, MN (US)

(73) Assignee: HealthPostures, LLC, Glencoe, MN (US)

( * ) Notice: Subject to any disclaimer, the term of this patent is extended or adjusted under 35 U.S.C. 154(b) by 0 days.

(21) Appl. No.: 11/151,688

(22) Filed: Jun. 13, 2005

(65) Prior Publication Data

US 2006/0061172 A1 Mar. 23, 2006

Related U.S. Application Data

(60) Provisional application No. 60/579,006, filed on Jun. 12, 2004.

(51) Int. Cl.
*A47C 1/024* (2006.01)

(52) U.S. Cl. ..... 297/300.8; 297/423.11; 297/423.12

(58) Field of Classification Search ..... 297/423.12, 297/423.11

See application file for complete search history.

(56) References Cited

U.S. PATENT DOCUMENTS

| | | | | | |
|---|---|---|---|---|---|
| 4,589,699 | A * | 5/1986 | Dungan | ..... | 297/423.12 |
| 4,614,378 | A * | 9/1986 | Picou | ..... | 297/92 |
| 4,650,249 | A * | 3/1987 | Serber | ..... | 297/313 |
| 4,832,407 | A * | 5/1989 | Serber | ..... | 297/423.12 |
| 5,149,174 | A * | 9/1992 | Charash | ..... | 297/423.12 |
| 5,255,957 | A * | 10/1993 | Opsvik et al. | ..... | 297/423.12 |
| 5,330,254 | A * | 7/1994 | Larson | ..... | 297/354.11 |
| 5,667,278 | A * | 9/1997 | Li | ..... | 297/423.13 |
| 5,669,669 | A * | 9/1997 | Usher | ..... | 297/423.12 |
| 5,857,747 | A * | 1/1999 | Mundkowski | ..... | 297/423.11 |
| D425,713 | S * | 5/2000 | Tholkes et al. | ..... | D6/335 |

* cited by examiner

*Primary Examiner*—David Dunn
*Assistant Examiner*—Erika Garrett
(74) *Attorney, Agent, or Firm*—Leffert Jay & Polglaze, P.A.

(57) ABSTRACT

An ergonomic chair having a cooperatively adjustable knee support and seat is herein disclosed. The knee support and seat may be adjusted to position a user of the chair in a physiologic attitude that approaches the neutral position.

7 Claims, 5 Drawing Sheets

ERGONOMIC CHAIR

RELATED APPLICATION

This application claims the benefit of U.S. Provisional Application No. 60/579,006, filed on Jun. 12, 2004, hereby incorporated herein in its entirety by reference.

TECHNICAL FIELD OF THE INVENTION

The present invention relates to a mechanism for supporting and positioning the body of a user in an ergonomic position with respect to a workstation or surface.

BACKGROUND OF THE INVENTION

In order to protect the health and well being of today's worker, it has become vital to organize the worker's environment around sound ergonomic principles. As part of this process, it is imperative that a worker be provided with suitable seating that will permit the worker to engage in their assigned tasks while minimizing the physical stresses associated with that task. The ergonomic principles around which a worker's environment is organized are described in some detail in U.S. Pat. Nos. 6,644,748, 6,702,372, and 6,726,276, all of which are hereby incorporated by reference.

DETAILED DESCRIPTION

Figure 1:
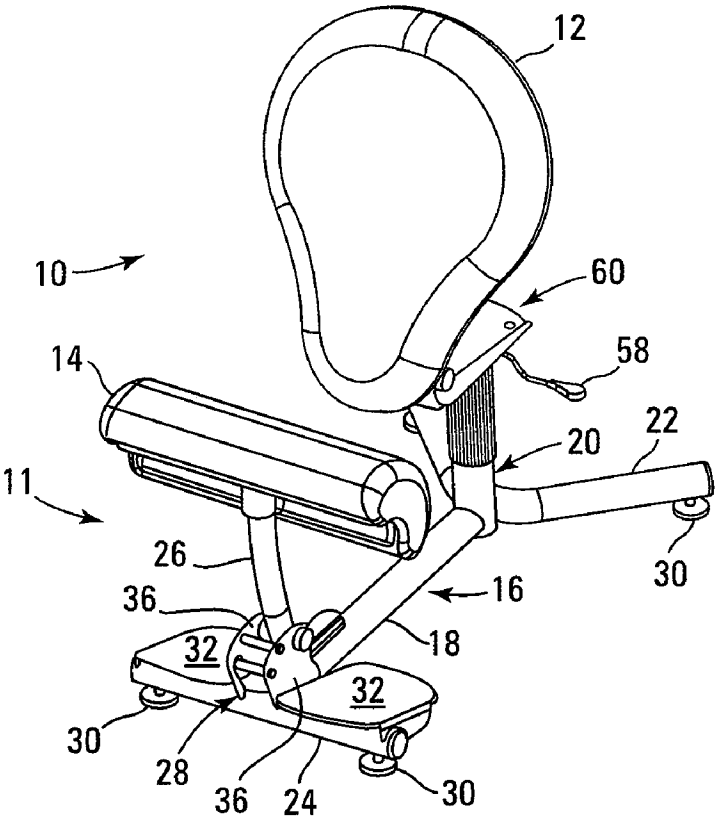
FIG. 1 is a perspective view of an ergonomic chair of the present invention in which the seat is in an upper, extended position.

In the following detailed description of the invention, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. The following detailed description is, therefore, not to be taken in a limiting sense, and the scope of the present invention is defined only by the appended claims and equivalents thereof.

Referring first to FIGS. 1-4, an ergonomic chair 10 constructed according to the principles of the present invention can be seen. The chair 10 is constructed and arranged to support the body of a user (not shown) in an ergonomically correct position, commonly referred to as a neutral position, with respect to a work surface or workstation. This position or posture minimizes the stresses that a worker experiences while performing his or her assigned tasks.

The chair 10 includes an adjustable seat 12 and an adjustable knee brace 11, including a knee support 14, that may be arranged with respect to one another to position the body of a user in a physiologic attitude that approaches a neutral position. The seat 12 and the knee support 14 are both connected to and supported by a frame 16. The frame 16 comprises a horizontal crosspiece 18, a seat post 20, a rear leg 22, and a front leg 24. The rear leg 22 and the front leg 24 are rigidly coupled to the horizontal crosspiece 18 to provide a substantially rigid base for the seat 12 and knee support 14. As illustrated in the FIGS., the seat post 20 may be rigidly coupled, as by welding, between the horizontal crosspiece 18 and the rear leg 22. Alternatively, the seat post 20 may be rigidly coupled, as by welding or the like, to an upper surface of the crosspiece 18 and/or rear leg 22. The frame 16 also comprises a knee support post 26 that is coupled to the horizontal crosspiece 18 by a detent mechanism 28.

Figure 2:
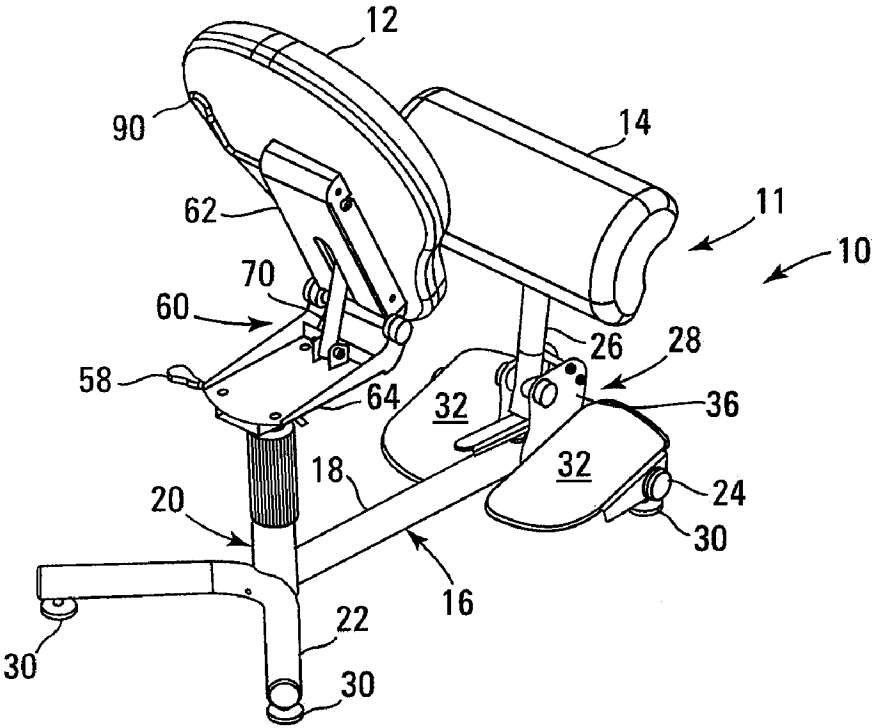
FIG. 2 is a rear perspective view of the ergonomic chair of FIG. 1.
Figure 4:
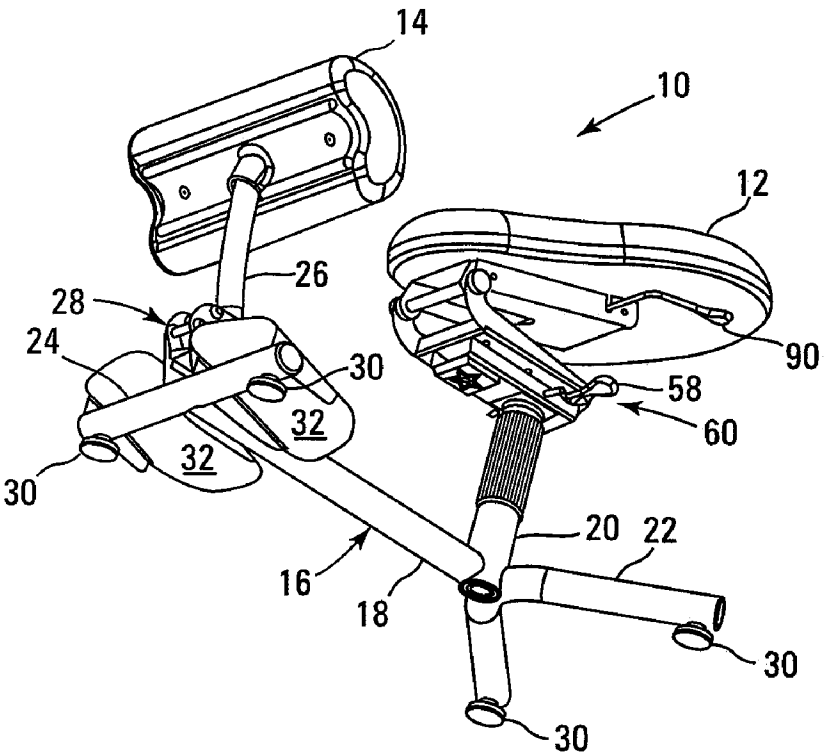
FIG. 4 is a rear perspective view of the ergonomic chair of FIG. 3.
Figure 3:
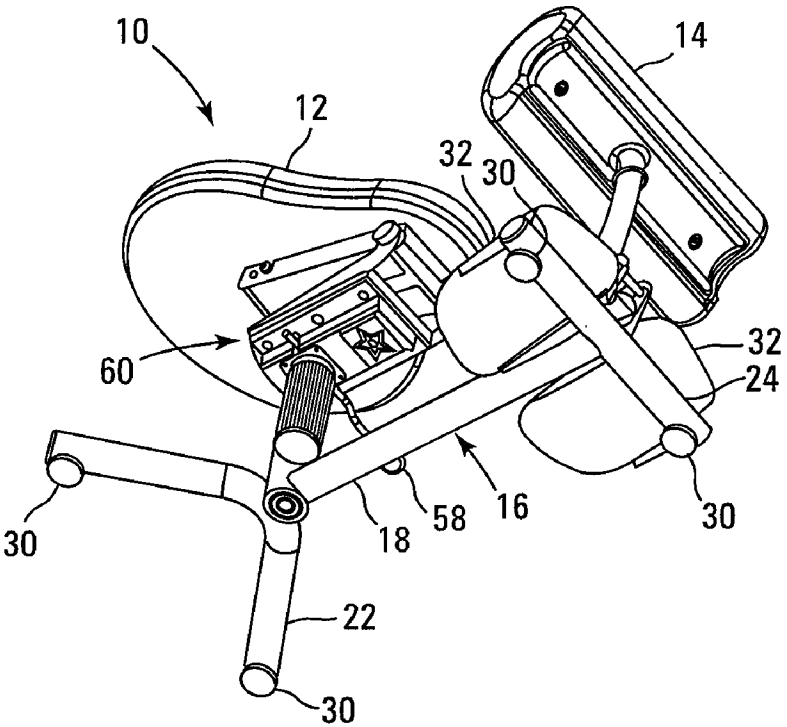
FIG. 3 is a perspective view of an ergonomic chair of the present invention showing the underside of the chair and in which the seat of the chair is in a lower, retracted position.

The seat 12 is rotatably coupled to the seat post 20 by a hinge mechanism 60 that allows the seat 12 to be rotated between its upper, extended position as illustrated in FIGS. 1 and 2 and its lower, retracted position as illustrated in FIGS. 3 and 4. In a preferred embodiment, the knee support 14 is rigidly secured to the knee support post 26. It is to be understood however, that the knee support 14 may be rotatably or otherwise adjustably secured to the knee support post 26 where the application for which the chair 10 is intended so requires.

In order to prevent the chair 10 from inadvertently sliding about on the floor, and to enable the chair 10 to be adjusted to accommodate an uneven floor, the frame 16 of the chair 10 is provided with and supported upon a number of adjustable, nonskid feet 30. Where required, the feet 30 may be omitted in favor of wheels or glides (not shown) or the like.

To ensure that the user maintains a proper physiologic attitude, the frame 16 is provided with a pair of footrests 32. The footrests 32 are rotatably coupled to the front leg 24. The foot rests 32 may be freely rotatable about the front leg 24, may be secured in any of a number of positions using a detent mechanism or set screw type device (not shown), or in an alternate embodiment, may be rigidly secured to the front leg 24 in a predetermined attitude with respect to the knee support 14 and seat 12. It is to be understood that the footrests 32 may also be omitted where desirable.

Figure 7:
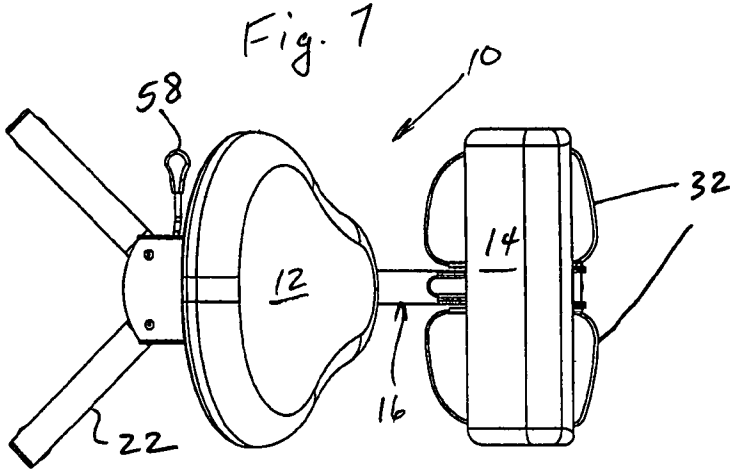
FIG. 7 is a top view of an ergonomic chair of the present invention wherein the seat is in an extended, upper position.
Figure 8:
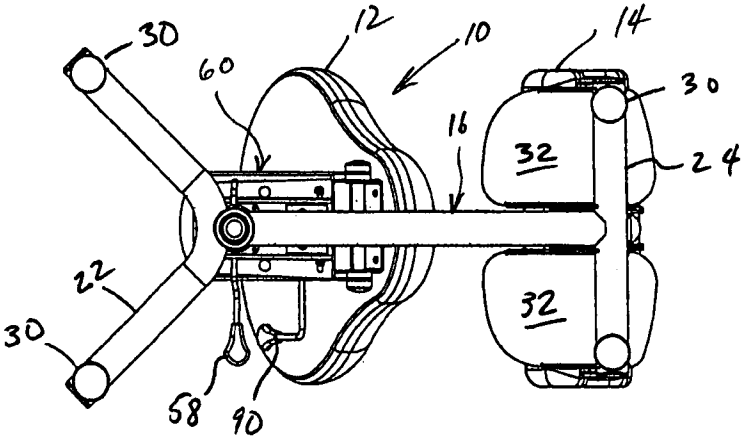
FIG. 8 is a bottom view of the ergonomic chair of FIG. 7.
Figure 5:
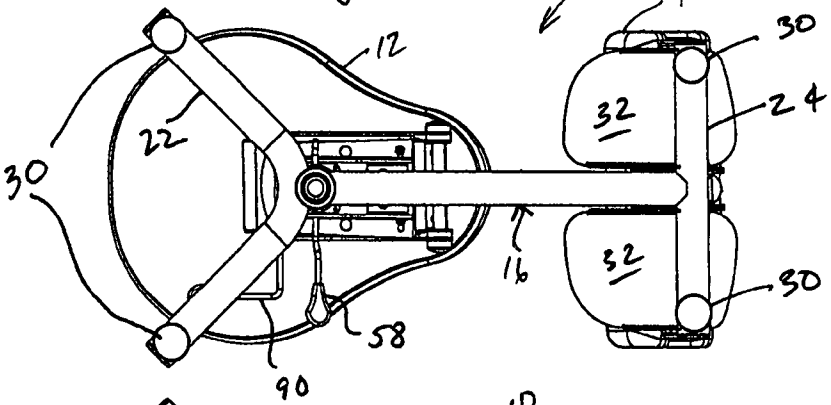
FIG. 5 is a bottom view of an ergonomic chair of the present invention wherein the seat is in a lower, retracted position.
Figure 6:
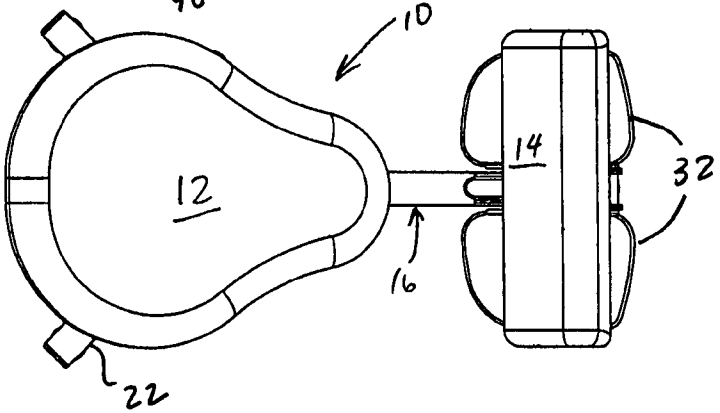
FIG. 6 is a top view of the ergonomic chair of FIG. 5.

FIGS. 5-8 are top and bottom views of the chair 10. FIGS. 5 and 6 illustrate the chair 10 from the bottom and the top, respectively, and both show the seat 12 in its lower, retracted position. FIGS. 7 and 8 illustrate the chair 10 from the top and the bottom, respectively, and show the seat 14 in its upper, extended position.

Figure 9:
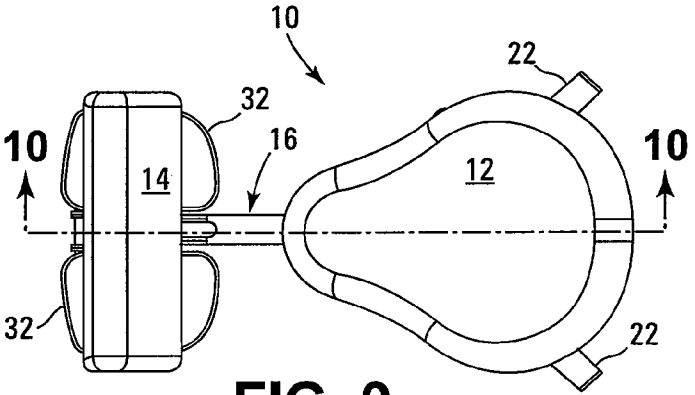
FIG. 9 is a top view of an ergonomic chair according to the present invention wherein the seat is in a lower, retracted position.
Figure 10:
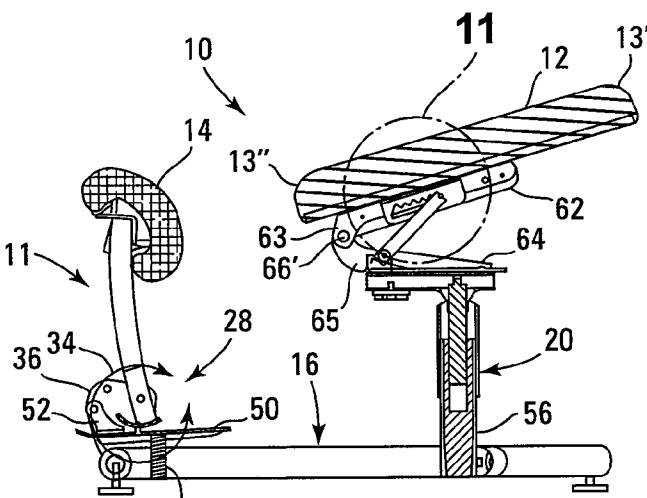
FIG. 10 is a cross sectional view of the ergonomic chair illustrated in FIG. 9 as viewed along cutting lines $\mathbf{10}^{-10;}$
Figure 17:
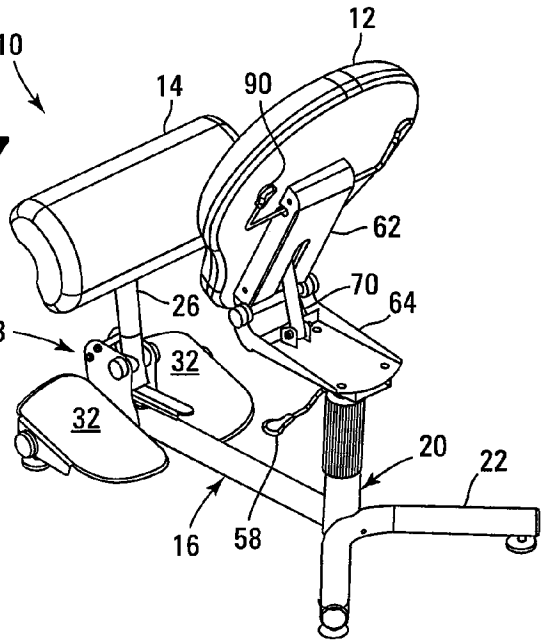

FIG. 9 also illustrates the chair 10 from above. FIG. 10 clearly illustrates the structures of the chair 10 that allow the seat 12 and knee support 14 to be adjusted with respect one another and with respect to the frame 16. As can be seen in FIG. 10, detent mechanism 28 permits the knee support 14 and knee support post 26 to rotate with respect to the frame 16. Arrow 34 defines a partial close-up view of the cross section of the detent mechanism 28 illustrated in FIG. 12.

The detent mechanism 28 includes a pair of support plates 36 that are rigidly secured at their lower edge to the horizontal crosspiece 18. The support plates 36 are arranged generally parallel to one another at a distance that is slightly greater than the diameter of the knee support post 26. A plurality of connectors 38 are secured between the support plates to connect the support plates 36 to one another and to rigidly maintain their planar positioning with respect to one another. The lower end of the knee support post 26 is coupled to the detent mechanism 28 by means of an axle or pivot pin 40. The axle 40 permits the knee support post 26 to be rotated in the directions indicated by arrows 41, 42. As a result, the knee support 14 is moved closer to the seat 12, when it is moved in the direction of arrow 42 and moved away from the seat 12 when it is moved in the direction of arrow 41. While in a preferred embodiment of the present invention the knee support post 26 is fashioned of a single solid tube, it may be desirable in some instances to incorporate a telescoping structure, or otherwise extendable and retractable structure into the knee support post 26.

Figure 12:
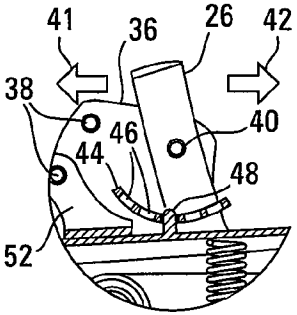
FIG. 12 is a close-up view of a detent mechanism that controls the angular position of the knee support post upon which is mounted the knee support of the ergonomic chair.
Figure 13:
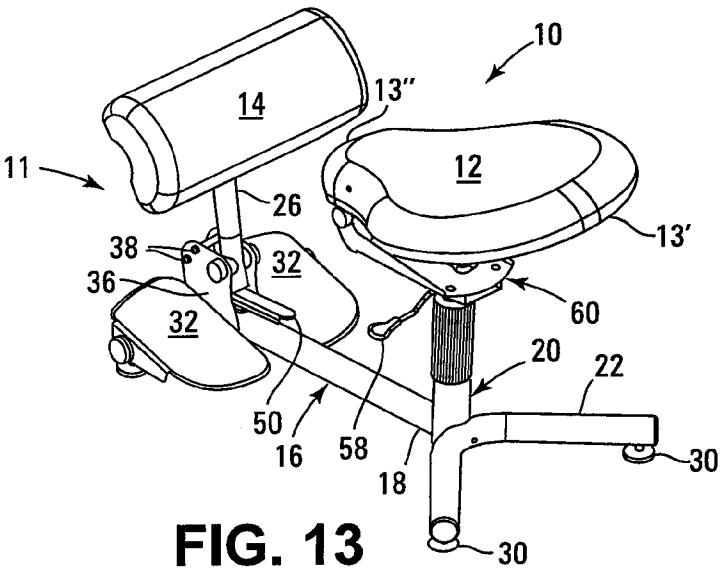
FIG. 13 is a perspective view of the ergonomic chair wherein the seat is in its lower, retracted position.

In order to control of the rotation of the knee support post 26, a detent plate 44 is secured to the lower end of the knee support post 26. As can be seen in FIG. 12, the detent plate 44 is preferably curvilinear in shape, though any suitable shape, whether curvilinear or rectilinear may be chosen. The detent plate 44 includes a plurality of detents 46 that each correspond to a predetermined angular position of the knee support post 26 with respect to the frame 16. A locking member 48 engages the detents 46 in the detent plate 44 to select and lock-in a particular position for the knee support post 26. The locking member 48 is movable toward and away from the detent plate 44 in order to permit selective engagement between the detents 46 in the locking member 48. A locking lever 50 that rotates between the support plates 36 about a connector 38 enables this movement. In a preferred embodiment, the locking lever 50 is coupled to a positioner 52 that is itself pinned between the support plates 36 by the connector 38. The locking lever 50 is biased upwardly toward the detent plate 44 by a spring 54 that is positioned between the undersurface of the locking lever 50 and the frame 16.

Applying an opening force to the distal end 51 of the locking lever 50 moves the distal end 51 of the locking lever, and hence the locking member 48, away from the detent plate 44 such that the locking member is moved out of engagement with the detents 46 of the detent plate 44. Once the locking member 48 is out of engagement with the detents 46 of the detent plate 44, the knee support post 26 may be rotated to a new position, whereupon the removal of the opening force that has been applied to the distal end 51 of the locking lever 50 will allow the spring 54 to reengage the locking member 48 with a selected detent 46, thereby locking the knee support post 26, and hence the knee support 14, into its selected position.

The seat 12, in the embodiment illustrated in the Figures, may be adjusted with respect to its height above the floor and in its angle with respect to the frame 16. As can be seen in FIG. 10, the seat post 20 may incorporate a height adjusting mechanism, such as a charged gas cylinder 56 of the type commonly used in the seating industry to adjust seat height in chairs. Note that the height adjusting mechanism may also comprise, among others, a screw mechanism repair of telescoping tubes having a detent or setscrew mechanism to adjust the length thereof. The gas cylinder 56 is controlled by lever 58 in a manner well known to those skilled in the art.

Figure 15:
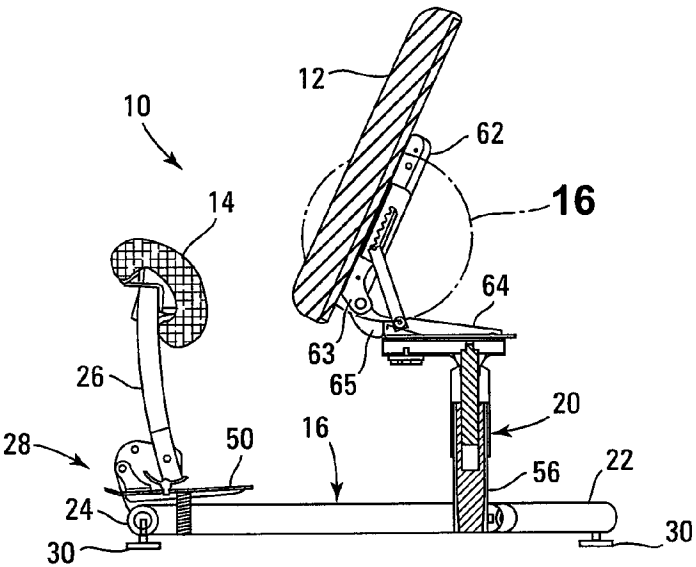
FIG. 15 is a cross sectional view of the ergonomic chair of FIG. 14 taken along cutting lines 15-15.

A hinge mechanism 60 is coupled between the top of the seat post 20 and the bottom surface of the seat 12. The hinge mechanism 60 comprises an upper leaf 62 and a lower leaf 64 that are hinged together to rotate about axle 66. In a preferred embodiment of the present invention, each of the upper and lower leaves 62, 64 includes a curvilinear extension 63, 65 through which the axle 66 passes. The extension 63, 65 offset the leaves 62, 64 away from one another and allow the rearmost portion 13' of the seat 12 to be positioned below the forward most portion 13" of the seat 12, if so desired. In any case, the hinge mechanism 60 permits the seat 12 to be rotated between a lower, retracted position such that illustrated in FIG. 10 and an upper, extended position such as that illustrated in FIG. 15. Generally speaking, the seat 12 may be rotated through a range of at least 90°.

Figure 11:
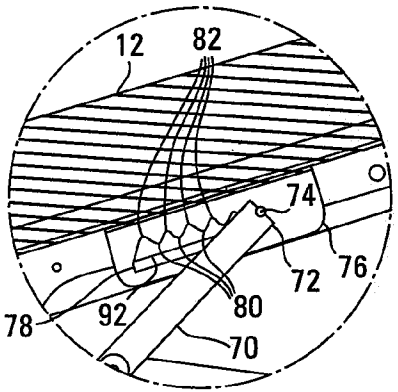
FIG. 11 is a close-up view of an adjustable support mechanism that modifies the angle of the seat of the ergonomic chair.
Figure 16:
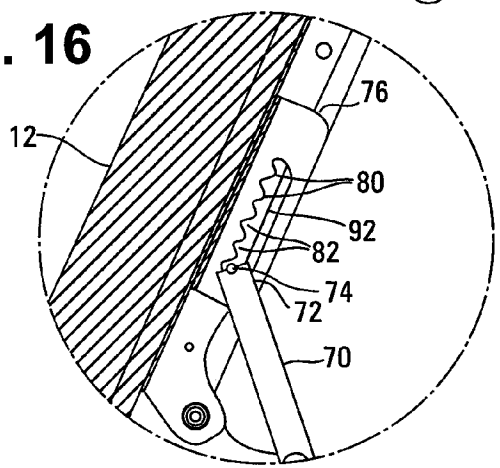
FIG. 16 is a close-up view of the adjustable support mechanism that modifies the angle of the seat of the ergonomic chair of FIG. 14; and, FIG. 17 is a perspective view of the ergonomic chair wherein the seat is in its upper, extended position.
Figure 14:
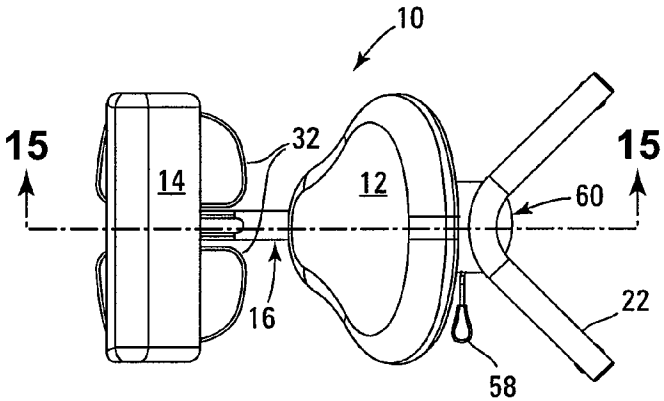
FIG. 14 is a top view of the ergonomic chair of the present invention in which the seat is in an upper, extended position.

An adjustable support mechanism 68 positively controls the angle of the seat 12 with respect to the frame 16. The adjustable support mechanism 68 can be most clearly seen in FIGS. 11 and 16. The support mechanism 68 includes two or more rotatable arms 70 that are rotatably pinned to the respective sides of the lower leaf 64 of the hinge mechanism 60 generally near the curvilinear extension 65 thereof by an axle(s) 71. Note that the arms 70 may be pinned to the lower leaf 64 in any suitable position that ultimately permits the control of the angle of the seat 12 with respect to the frame 16.

A pin 74 connects the distal ends 72 of the arms 70 to one another. The pin 74 passes through slots 78 formed in a respective pair of locator plates 76. Each of the locator plates 76 is secured to the seat 12 and/or the upper leaf 62 of the hinge mechanism 60. The locator plates 76 are arranged in general planar arrangement with one another and their slots 78 are similarly aligned with one another. Each of the slots 78 is provided with a given number of teeth 80, which define a number of gullets 82 therebetween. The gullets 82 are constructed and arranged such that the pin 74 connecting the arms 70 may be simultaneously received into a pair of corresponding gullets 82. Furthermore, the gullets 82 are positioned within the slots 78 such that when a pin 74 is received in a corresponding pair of gullets 82, each of the arms 70 forms the same angle with respect to the frame 16 as its counterpart arm, thereby ensuring that the seat 12 is supported at a uniform angle and does not rack. By positioning the pin 74 in successive pairs of corresponding gullets 82, the seat 12 may be angularly raised or lowered by a predetermined increment defined by the pitch of the teeth 80 that define the gullets 82. The adjustable support mechanism 68 essentially forms the third leg of a triangular structural member that encompasses the upper and lower leaves 62, 64 of the hinge mechanism. The axle 66 of the hinge mechanism 60, the pin 74, and the axle 71 define the apexes of the triangular structural member.

A spring or other resilient device (not shown) may be coupled between the leaves 62, 64 of the hinge mechanism 60 to assist in adjusting the angle of the seat 12, though this feature of the chair 10 may be omitted.

A lever 90 is provided to control the position of the pin 74 within the gullets 82 of the adjustable support mechanism 68. The lever 90 is coupled to an actuator 92 that is positioned between the pin 74 and the underside of the seat 12. Rotating the lever 90 in a predetermined direction causes the actuator 92 to press against the pin 74, thereby forcing it from the gullets 82 in which the pin 74 was seated. The seat 12 may be then be raised or lowered, as desired. Once the seat 12 is in its desired position, the lever 90 is released and the actuator 92 ceases to force the pin 74 from the gullets 82, thereby allowing the pin 74 to once again engage the selected pair of gullets 82 to secure the seat 12 in its selected attitude. The lever 90 and/or the actuator 92 are preferably biased so as to normally maintain the actuator 92 away from the pin 74. Applying a force to the lever 90 overcomes this bias and forces the actuator 92 into the pin 74.

In another embodiment of the present invention, a single telescoping structure such as a gas cylinder may be coupled between the upper and lower leaves 62, 64 of the hinge mechanism 60 in lieu of the pair of arms 70. Where a telescoping structure capable of being locked into a set length is used, the locator plates 76 and pin 74 may be omitted. In yet another embodiment, the chair 10 may include a single tube or bar in lieu of a pair of arms 70. In this embodiment, the pin 74 would extend outwardly from the single, centrally positioned tube or bar to engage the gullets 82 in the locator plates 76.

In operation, the chair 10 may be adapted to ergonomically support a user in a comfortable position that preferably closely approximates a physiologically neutral position. The seat 12 may be raised or lowered by means of the gas cylinder 56 or the like to accommodate variations in height of the user. Similarly, the detent mechanism 28 may be used to rotate the knee support 14 into a proper position with respect to the seat 12 to accommodate differences in the lengths of the legs and particularly, the thighs, of different users. Finally, the seat 12 may be rotated with respect to the frame 16 by means of the adjustable support mechanism 68 in order to attain the proper hip arrangement required to approximate a neutral position for the user before a selected workstation or work surface.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. An ergonomic chair comprising a seat and a knee brace adjustably coupled to a frame, the seat and the knee brace being adjustable with respect to one another so as to position a user of the chair in a generally neutral physiologic position, wherein the knee brace comprises a knee support and a support post, the support post rotatably pinned between a pair of support plates that are rigidly secured to the frame of the chair, a distal end of the support post opposite the knee support having secured thereto a detent plate that rotates past a locking member as the support post is rotated, the locking member being selectively engageable with one of a plurality of detents formed in the detent plate, the locking member being mounted upon a rotatable locking lever that is pinned for rotation between the pair of support plates.

2. The ergonomic chair of claim 1 wherein the seat of the chair is coupled to the frame by means of a height adjustment mechanism.

3. The ergonomic chair of claim 1 wherein the seat of the chair is rotatable about a generally horizontal axis.

4. The ergonomic chair of claim 1 wherein the knee brace is constructed and arranged to be rotated towards and away from the seat of the chair about a generally horizontal axis.

5. The ergonomic chair of claim 1 wherein the knee brace is coupled to the frame of the chair by means of a height adjustment mechanism.

6. The ergonomic chair of claim 1 wherein the seat is coupled to the frame by means of a hinge mechanism.

7. The ergonomic chair of claim 6 further comprising an adjustable support mechanism that is operatively engaged between an upper leaf and a lower leaf of the hinge mechanism to support the seat of the chair at one of a number of preselected angular positions.

* * * * *